US005875609A

United States Patent [19]

Quinif

[11] Patent Number: 5,875,609

[45] Date of Patent: Mar. 2, 1999

[54] EXPANDABLE SPACER CORES FOR PANEL DOORS AND THE METHOD OF MAKING SAME

[76] Inventor: Edward G. Quinif, 6237 Sage Dr., Scottsdale, Ariz. 85253

[21] Appl. No.: 854,357

[22] Filed: May 12, 1997

[51] Int. Cl.[6] ..... E04C 2/36; E06B 3/74

[52] U.S. Cl. ..... 52/784.14; 52/456; 52/793.1; 52/794.1; 428/116

[58] Field of Search ..... 52/456, 457, 784.14, 52/784.15, 784.25, 793.1, 794.1; 428/116

[56] References Cited

U.S. PATENT DOCUMENTS

| | | | |
|---|---|---|---|
| 2,511,620 | 6/1950 | Clements | 52/784.14 X |
| 2,809,403 | 10/1957 | Clements | 52/784.14 X |
| 3,385,002 | 5/1968 | Quinif | 52/784.14 X |
| 4,583,338 | 4/1986 | Sewell et al. | 52/784.14 X |
| 5,167,105 | 12/1992 | Isban et al. | 52/784.15 X |
| 5,236,392 | 8/1993 | Fauciglietti | 52/455 |
| 5,573,818 | 11/1996 | Haywood et al. | 52/793.1 X |

*Primary Examiner*—Christopher Kent
*Assistant Examiner*—Timothy B. Kang
*Attorney, Agent, or Firm*—Dykema Gossett PLLC

[57] ABSTRACT

A door is provided that has a first outer skin and a second outer skin. A first and second outer skins are separated by frame to form a hollow core between the frame and the outer skins. An expandable spacer is connected to the first and second skins to hold the first and second skins a predetermined distance apart. The expandable spacer has a plurality of elongated members having a width. The elongated members are each oriented substantially perpendicular to the first and second outer skins. The expandable spacer has a plurality of expandable core liners extending between the elongated members. The expandable core liners orient the elongated members with respect to the first and second outer skins in a perpendicular direction. The elongated members having a reduced width portion formed therein that corresponds to the molded portion of the first skin. A reinforcement layer may be applied to the elongated members at the narrowed portion to support the narrowed portion.

23 Claims, 2 Drawing Sheets

EXPANDABLE SPACER CORES FOR PANEL DOORS AND THE METHOD OF MAKING SAME

BACKGROUND OF THE INVENTION

The present invention relates generally to hollow core doors and more specifically to an expandable core structure inserted within the interior of the door to provide support for the skins of the door.

Hollow core doors are commonly used in many types of buildings. The common structure of a hollow core door includes a pair of door skins which are separated by a wood frame. The wood frame has vertical wood stiles joined to upper and lower horizontal wood rails. The wood stiles and rails form the edges of the door. A lock block may also be included in the area of the door where locks and handles are attached. A hollow area is enclosed between the two door skins and within the frame. The hollow area typically requires some type of structural reinforcement.

One type of reinforcement commonly used in hollow core doors is a honeycomb core structure that is glued in place between the door skins. The honeycomb core structure may be, for example, corrugated board. The honeycomb structure is supplied in an unexpanded manner. The honeycomb core is stretched across the skin of the interior of the door. One problem with using such a honeycomb core structure is that it is difficult to stretch to achieve an even honeycomb pattern within the door. Commonly, the honeycomb core must be overstretched and then manipulated into place. This process is labor intensive and thus not a cost effective manner for manufacturing the door.

The honeycomb core fully extends between the horizontal rails and vertical stiles to completely fill the hollow interior. Consequently, more core material is inserted within the interior of the door than is actually required for support. The extra core material increases the cost of the door.

The honeycomb core has also been routed out in places to fit over the panels of molded doors. Such a honeycomb version failed because it was not possible to control the spread of members or strips since some of the members or strips would get caught or hung up on the top of the panels. Also, over expansion of the honeycomb core was hard to control.

Another type of door reinforcement includes solid blocks placed strategically between the door skins. The solid blocks are commonly formed of laminated strips of corrugated or from pieces of styrofoam. The use of multiple pieces of strips or blocks laid in the doors takes more set up time and requires a large quantity of material which is expensive. Also, these solid blocks require a significant amount of glue to be spread over their entire surface to bond to outer skins of the door.

The outer skins of hollow core doors maybe formed using a planar flush panel or they may have contoured colonial-type molded panel configuration. In a colonial-type panel configuration, a portion of the panel extends within the hollow interior of the door. The thickness of the hollow space in that area is reduced. Inserting a honeycomb structure or core in such a door is undesirable since the honeycomb core would have to be reduced in thickness in the areas where the panel extends within the hollow interior of the door.

It is therefore desirable to provide a structural to provide a structural core or support for a hollow core door which requires less set-up time and is cost effective by being easy to manufacture and by using a reduced amount of core material and glue.

SUMMARY OF THE INVENTION

It is therefore an object of the invention to provide and improved construction for a hollow core door and in particular a panel door.

In accordance with one aspect of the invention, a door is provided that has a first outer skin or panel and a second outer skin or panel on opposite sides of the door frame. First and second outer skins are separated by a frame to form a hollow interior or space therebetween. An expandable spacer core is connected to the first and second skins and hold the first and second skins a predetermined distance apart. The expandable core spacer has a plurality of elongated or corrugated members having a width. The elongated members are each oriented substantially perpendicular to the first and second outer skins. The expandable spacer core has a plurality of expandable core liners extending between the elongated members. The expandable core liners orient the elongated members with respect to the first and second outer skins. Each elongated member has a reduced width portion formed therein that corresponds to the molded portion of the first skin.

In accordance with another aspect of the invention, a method for forming a door includes applying a reinforcement layer to a corrugated layer, applying adhesive to an adhesive region of a plurality of strips of foldable material, arranging a plurality of strips of foldable material between a plurality of corrugated layers, cutting through the plurality of corrugated layers and across the foldable material to form an expandable spacer core held together by the foldable material, reducing a width of the expandable spacer core at the reinforcement layer, and affixing the expandable spacer core between a pair of spaced apart first and second outer skins.

It is an advantage of the invention that the expandable spacer cores are easily placed within the interior of the hollow core doors thus resulting in relatively less manufacturing time. In particular, the core liners hold the elongated members upright and perpendicular to the outer during assembly.

Yet another advantage is that the expandable spacer cores may be placed so as not to interfere with any reduced thickness in a panel-type door. The expandable spacer core may easily be stretched into place without catching on the molded portions.

In forming the door, an adhesive is applied to the edges of the expandable spacer core. The expandable spacer core is placed on the hollow space side of an outer skin. The frame of the door may also be connected to the hollow core space of an outer skin. The second outer skin is then placed on top of the frame and the expandable spacer cores to form the door.

Thus, in the present invention, the expandable spacer cores are placed in strategic areas to support the door skins. The spacer core provide support along the outer edges and along the middle of the door to provide strength. The expandable core liners hold the elongated corrugated elements at right angles to the skin. The routed out areas of the core liners contact the molded areas to keep the panel strips at right angles to the skins.

BRIEF DESCRIPTION OF THE DRAWINGS

Others features and advantages of the present invention will become apparent from the following detailed description which should be read in conjunction with the drawings in which.

DETAILED DESCRIPTION OF THE PREFERRED EMBODIMENT

Figure 1:
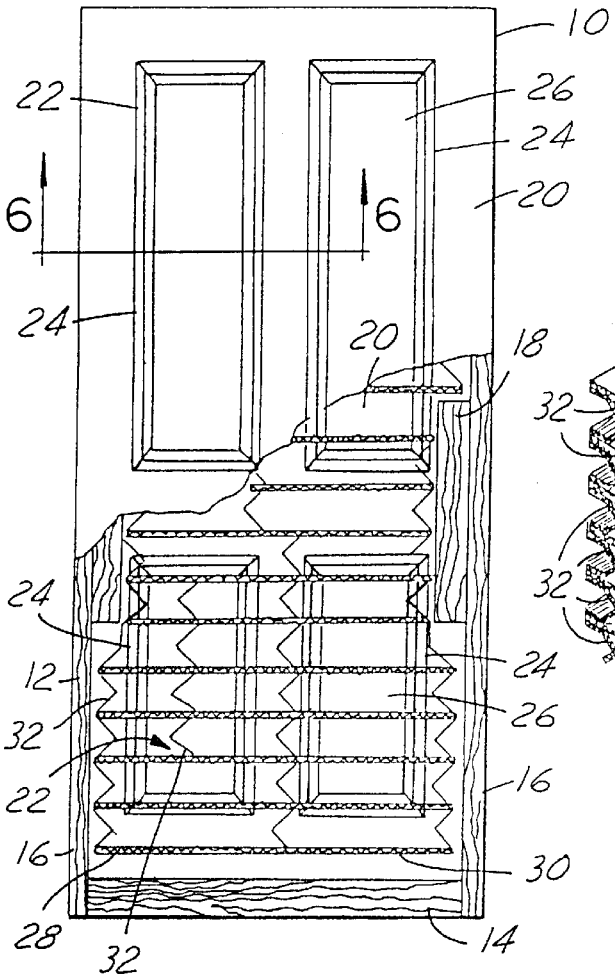
FIG. 1 is an elevational view of a hollow core door with parts broken away to expose the interior of the door.

Referring now to the drawings like reference numerals are used to identify identical components in the various views. Although the invention will be illustrated in the context of a hollow core six panel door, it will be appreciated that this invention may be used with other hollow core doors, as examples, flush doors or other molded panel doors.

Referring now to FIG. 1, a hollow core door 10 has a frame 12 around its perimeter. Frame 12 comprised horizontal rails or stiles 14 and vertical stiles 16. In the preferred embodiment horizontal rails 14 and vertical stiles 16 are formed of solid wood. A lock block 18 may also be part of the supporting structure of door 10. Lock block 18 is used at the location in which the door handle and locks may be fastened.

Door 10 has a pair of outer skins, sheets, or panels 20, a portion of which has been removed to reveal the inner structure of door 10. Outer skins 20 may be planar as in a flush-type door. The outer skin 20 as shown incorporates a number of molded panels 22. Panels 22 consist of a molded portion 24 and a planar portion 26. It is preferred that planar portion 26 lies on the same plane as the portions of the doors between panels 22 and the portions adjacent to frame 12.

To provide structural rigidity and to hold the outer skins 20 apart, a rigid expandable space core 28 is affixed between outer door skins 20. Expandable spacer core 28 has a pair of elongated members 30 that are preferably perpendicular to the plane of outer skins 20. Elongated members 30 extends substantially across the width of door 10. Because the area adjacent lock block 18 is narrower, elongated members 30 may be bent or shortened in that area. Elongated members 30 also have a plurality of expandable core liners 32 that are also preferably perpendicular to the plane of outer skins 20. It is also preferred that the expandable core liners do not cross molded portions 24. In some panel doors the distance between the molded portions are wide and the elongated members 30 may need extra support to stay perpendicular to outer skins 20. Optionally, expandable core liners 32 may be strategically placed between molded portions 24 adjacent to planar portion 26 for extra support. Expandable core liners 32 support elongated members 30 substantially perpendicular to outer skins 28. Expandable spacer core 28 is preferably freestanding so that it maintains its position during assembly. In the preferred embodiment, elongated members 30 are formed of a corrugated board material. Expandable core liners 32 may be formed of a single face corrugated board material or paper.

Figure 2:
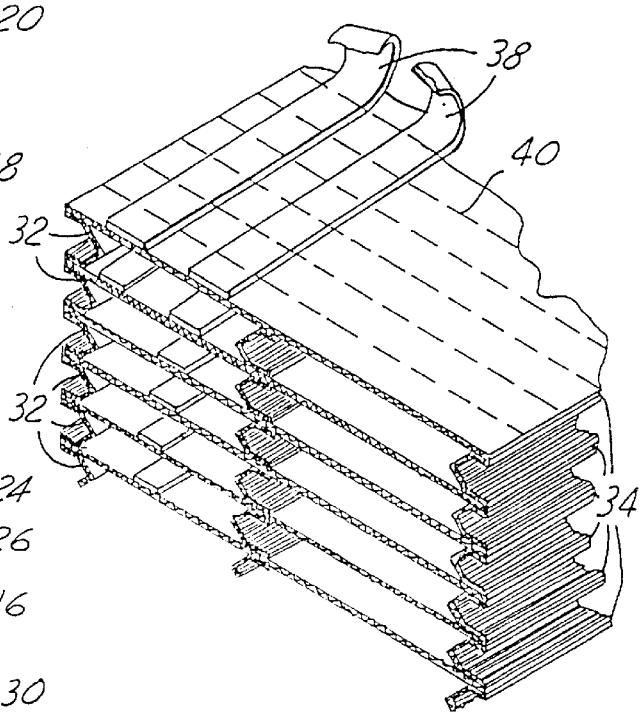
FIG. 2 is a fragmentary perspective view of a set of corrugated boards, sheets or layers connected by expandable core liners prior to being cut to form the expandable spacer cores.

Referring now to FIG. 2, the first step in forming an expandable spacer core 28 is shown. Expandable core liners 32 are shown in their relative positions to corrugated boards, sheets or layers 34. Only six corrugated layers 34 are illustrated. In one constructed embodiment, fourteen corrugated layers 34 were used. Expandable core liners 32 are folded pieces of corrugated board material or paper. Expandable core liners 32 are preferably placed parallel to each other. For a common door width, two or three expandable core liner 32 may be used across the width of corrugated layers 34. Each of corrugated layers 34 are connected to the adjacent layer by expandable core liners 32.

An adhesive region 36 that extends along the elongated edges of expandable core liners 32 is the area on expandable core liners 32 to which adhesive is applied. Adhesive may be applied to the adhesive region 36 prior to joining the corrugated layers or sheets 34 together. Each expandable core liners 32 has two adhesive regions 36. Adhesive regions 36 are on opposite elongated edges of expandable core liners 32.

Corrugated layers or sheets 34 may have reinforcement layers 38 applied thereto. Reinforcement layers 38 may for example be a tape-like material. Tape-like material may be reinforced with fiberglass or nylon to increase strength. Reinforcement layer 38 aligns with molded portions 24 of door 10.

Expandable core liners 32 are shown affixed to corrugated layers 34. Corrugated layers 34, expandable core liners 32 and reinforcement layer 38 are cut along cut lines 40. Cut lines 40 run in a direction across expandable core liners 32 so that after cutting, expandable core liners 32 hold together the strips of corrugated layers 34. The cuts along cut lines 40 may be performed using a rip saw or other similar cutting mechanism. Once cut, the corrugated layers 34 form elongated members 30 of FIG. 1.

Figure 3:
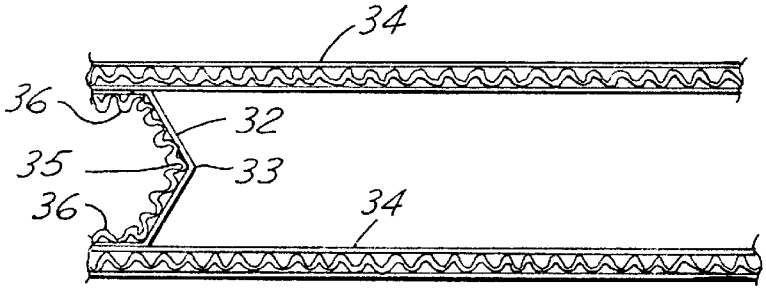
FIG. 3 is a fragmentary cross-sectional view of a pair of elongated or corrugated members separated by a expandable core liner.

Referring now to FIG. 3, a cross-sectional view of a expandable core liner 32 is shown. Expandable core liner 32 has a fold line 33 to allow adjacent corrugated layers 34 to be brought closer together. Adhesive region 36 are shown bonded to their respective corrugated layers 34. During cutting of the corrugated layers 34, along cut lines shown as 40 in FIG. 2, the rip saw provides a large force. The large force has a tendency to skew corrugated layers 34 with respect to each other. To alleviate this problem, it is preferred that single face corrugated layers are used so that the ribbed layer 35 if expandable core liners 32 are aligned so that the ribbed layer 35 fits into itself when expandable core liners 32 are folded between corrugated layers 34 to interlock. The interlocking of the expandable core liner 32 helps corrugated layers 34 remain aligned during the cutting process. Another advantage of having the corrugated layers 35 of expandable core liners 32 align are that if the expandable spacer cores 28 are to be shipped, the interlocking corrugated layers 35 help prevent corrugated layers 34 from becoming misaligned.

Figure 4:
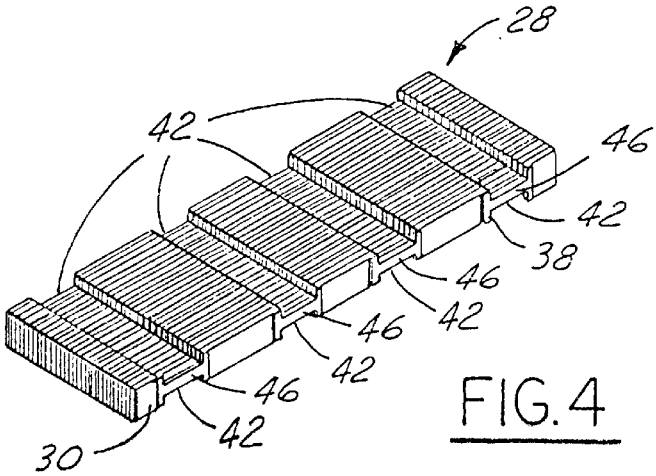
FIG. 4 is perspective view of an expandable spacer core in a compressed configuration prior to expansion for insertion into the interior of a hollow core panel door.

Referring now to FIG. 4 expandable spacer core 28 is shown in an unexpanded state. After being cut along cut lines 40 of FIG. 2, elongated members 30 are placed close together. Channels 42 are cut through the edges of expandable spacer core 28 to a predetermined depth. Channels 42 are preferably cut in pairs so that the pairs in the opposite edges of expandable spacer core 28 form a narrowed portion 46. The depth of the narrowed portion is such that the narrowed portion 46 touches the molded portions when inserted in the hollow core. Channels 42 may be cut using a router, saw or a similar tool. Channel 42 align with the reinforcement layer 38 of tape. After channel 42 are cut a portion of reinforcement layer 38 is preferably retained on either side of the channel 42 and on the narrowed portion 46. Reinforcement layer 38 helps reinforce the narrow strip of elongated member 30 between the channels 42 on opposite edges of expandable spacer core 28 during cutting of channels 42 as well as further manipulation of expandable spacer core 28 during manufacture of the door.

Figure 6:
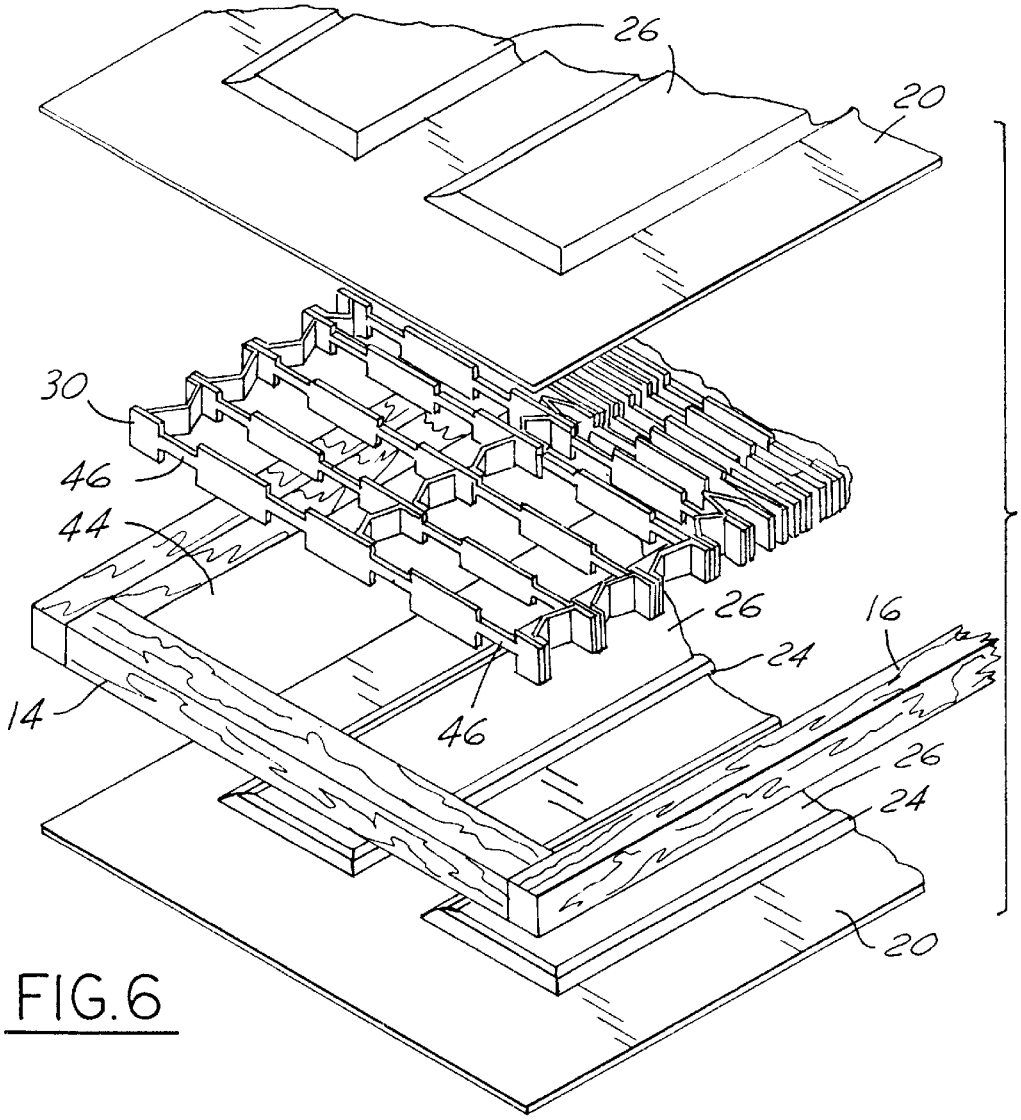
FIG. 6 is a fragmentary exploded view of the door illustrating the component parts in an unassembled condition.
Figure 5:
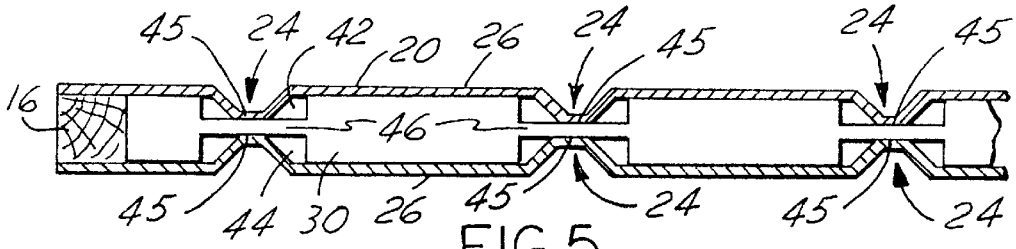
FIG. 5 is a fragmentary cross-sectional view of a door with an expandable spacer core inserted between the outer door skins or panel.

Referring now FIG. 5 and 6, expandable spacer core 28 fits within the interior or space 44 of the hollow core door. Elongated members 30 and expandable core liners 32 support outer skins 20. Vertical rails 16 separates the outer edge of outer skins 20. Molded portions 24 preferably have a flat portion 45. Narrow portion 46 rest against flat portion 45 of molded portion 24. It has been found that in an assembled door, that the flat portions 45 of molded portions 24 assist in holding elongated members 30 perpendicular to outer skins 20. It is preferred that the width of narrowed portion 46 corresponds to the distance between flat portions 45 molded portions 24.

The areas in which channels 42 are not machined are strategically placed between the edges of the door and the molded portions 24, within the molded portions 24 against planar portions 26 and between the molded panels. In this manner a significant amount of support may be applied between the outer door skins.

During assembly of door 10, the expandable spacer core 28 is manufactured as described above. Expandable spacer cores 28 may be manufactured at a separate location and brought to the assembly line where the doors are manufactured at Outer skins 20 are typically placed in a horizontal position. Frame 12 and lock block 18 may then be connected to an outer skin 20. Adhesive is then applied to the edges of expandable spacer core 28. This may occur using a double sided glue spreader common in the industry. This may also occur one edge at a time. Expandable spacer core 28 is then expanded within hollow interior or space 44. Expandable core liners 32 hold elongated members 26 in a freestanding state in an orientation perpendicular to the plane of outer skin 20. If adhesive has not been applied to the second edge of expandable spacer core 28, adhesive may then be applied. Outer skin 20 is placed to contact frame 12 and expandable spacer 28. Once the adhesive is set, door 10 has been formed.

While the best mode for carrying out the present invention has been described in detail, those familiar with the art to which this invention relates will recognize various alternative designs and embodiments for practicing the inventions as defined by the following claims:

What is claimed is:

1. An expandable spacer core for insertion into a door having skins with molded portions, said spacer core having an expanded form and a collapsed form comprising:

a plurality of elongated members which are generally parallel to one another;

a plurality of expandable core liners extending between said elongated members;

each of said expandable core liners being foldable along a fold line located generally in the middle thereof and having a pair of end portions secured to a pair of adjacent elongated members;

said expandable core liners being stretchable about the fold line to permit variable spacing between said elongated members when the core is in its expanded form;

said elongated members being provided with slots in the front and back, surfaces thereof to provide reduced width portions thereon corresponding to the molded portions; and said expandable core liners being provided with slots in the front and back surfaces thereof to provide reduced width portions thereon corresponding to the molded portions;

said spacer core having the same width when in either of said forms and having a reduced length when in said collapsed form and an extended length when in said expanded form.

2. The expandable spacer core recited in claim 1, wherein said expandable core liners are formed of a single ply corrugated material.

3. The expandable spacer core recited in claim 1, wherein said expandable core liners when said core is in said collapsed state interlock upon themselves.

4. The expandable spacer core recited in claim 1, wherein said elongated members are formed of a two-ply corrugated material.

5. The expandable spacer core recited in claim 1, wherein said expandable core liners are arranged in a plurality of rows.

6. The expandable spacer core recited in claim 1, wherein said expandable core liners are arranged in a pair of rows.

7. The expandable spacer core recited in claim 1, wherein said expandable core liners are arranged in three rows, with one row in the center of the elongated members, said other rows being spaced from the ends of the elongated members on opposite sides of said center row.

8. The expandable spacer core recited in claim 1, wherein said elongated members are provided with reinforcement layers; said reinforcement layers applied to said reduced width portions of said elongated members and to areas adjacent to said reduced width portions.

9. The expandable spacer core recited in claim 8, wherein each of said reinforcement layers comprises a tape.

10. The expandable spacer core recited in claim 9, wherein said tape comprises nylon.

11. The expandable spacer core recited in claim 9, wherein said tape comprises fiberglass.

12. A hollow core door comprising:

a rectangular frame, including a pair of side stiles parallel to each other, and upper and lower rails also parallel to each other, all of said stiles and rails being of substantially the same predetermined thickness, having their end faces lying in parallel planes, and being joined respectively at the frame corners.

an expandable structural spacer core disposed within said frame and having front and back surfaces lying in said parallel planes, said spacer core having a plurality of spaced apart elongated members which are generally parallel to one another and a plurality of expandable core liners extending between said elongated members;

said spacer core being made from a material having a collapsed form and an expanded form which permits expansion of said spacer core from collapsed form into its expanded form in the longitudinal direction of the door and frame, with said spacer core having the same width when in either said collapsed form or expanded form;

a first outer skin and a second outer skin secured to opposite sides of said frame with said skins having panels formed therein, each of said panels outlined by a raised molding at the interior surface on said skin;

said skins also being secured to said front and back surfaces of said expandable spacer core, said expandable spacer core holding said first and second skins a predetermined distance apart;

said elongated members being located between and arranged generally perpendicular to said stiles;

said expandable core liners holding said elongated members substantially perpendicular to said outer skins during assembly;

each of said expandable core liners being foldable along a fold line located generally in the middle thereof and having a pair of end portions secured to a pair of adjacent elongated members;

each fold line being generally perpendicular to said skins;

said expandable core liners when in the expanded form being arranged lengthwise in said frame in end to end relationship in a plurality of rows which are space part;

portions of said elongated members provided with slots in the front and back surfaces to provide reduced width portions thereon;

portions of said expandable core liners provided with slots in the front and back surfaces thereof to provide reduced width portions thereon;

each of said expandable core liners being stretchable about the fold line to permit variable spacing between said elongated members when the core is in its expanded form to overly said raised moldings;

the reduced portions of said elongated members and said core liners overlying said raised moldings to provide support for said skins.

13. The hollow core door recited in claim 12, wherein said expandable core liners are formed of a single ply corrugated material.

14. The hollow core door recited in claim 12, wherein said elongated members are formed of a two-ply corrugated material.

15. The hollow core door recited in claim 12, wherein said expandable core liners are arranged in said rows inwardly spaced from the ends of said elongated members.

16. The hollow core door recited in claim 12, wherein said expandable core liners are arranged in a pair of spaced apart rows.

17. The hollow core door recited in claim 12, wherein said expandable core liners are arranged in three spaced apart rows.

18. The hollow core door recited in claim 12, wherein said expandable core liners are arranged in three rows, with one row in the center of the elongated members, said other rows being located adjacent the ends of said elongated members on opposite sides of said center row.

19. The hollow core door recited in claim 12, wherein there are a pair of mounting blocks extending inwardly from a portion of each of said stiles, any elongated member located between said mounting blocks having a reduced length to accommodate said mounting blocks.

20. The hollow core door recited in claim 12, wherein said expandable core liners has one row in the center of the door and the other rows equally spaced on opposite sides of the center row.

21. The hollow core door as recited in claim 12, wherein said tape reinforcement layers comprises a tape.

22. The hollow core door as recited in claim 21, wherein said tape comprises nylon.

23. The hollow core door as recited in claim 21, wherein said tape comprises fiberglass.

* * * * *

UNITED STATES PATENT AND TRADEMARK OFFICE

CERTIFICATE OF CORRECTION

PATENT NO. : 5,875,609

DATED : March 2, 1999

INVENTOR(S) : Edward G. Quinif

It is certified that error appears in the above-identified patent and that said Letters Patent is hereby corrected as shown below:

Column 1, line 18, after "attached.", insert --The lock block provides the additional support that is needed to secure a lock in the door.--
Column 1, line 65, cancel "to provide a structural".
Column 2, line 4, cancel "and" and substitute --an--.
Column 2, line 64, cancel "Others" and substitute --Other--.
Column 4, line 49, cancel "if" and substitute --of--.
Column 5, line 33, cancel "tured at" and substitute --tured.--
Column 5, between lines 64 and 65 (claim 1), insert --said expandable core liners being arranged lengthwise in end to end relationship in a plurality of rows which are spaced apart;--.
Column 5, line 65 (claim 1), before "said expandable", insert --each of--.
Column 7, line 18 (claim 12), cancel "space" and substitute --spaced--.
Column 7, between lines 24 and 25 (claim 12), insert --said elongated members having reinforcement layers applied thereto, said reinforcement layers applied to said reduced width portions of said elongated members and to areas adjacent thereto;--.
Column 8, line 28 (claim 21), after "wherein", insert --each of--.
Column 8, line 29 (claim 21), cancel --tape-- (first occurrence)

Signed and Sealed this

Twentieth Day of July, 1999

*Attest:*

*Attesting Officer*

Q. TODD DICKINSON

*Acting Commissioner of Patents and Trademarks*